United States Patent [19]

Dodd, Jr.

[11] 4,215,628

[45] Aug. 5, 1980

[54] INFUSION AND STIRRING DEVICE

[76] Inventor: William A. Dodd, Jr., 2707 Foxfire Ct., Clearwater, Fla. 33515

[21] Appl. No.: 934,900

[22] Filed: Aug. 18, 1978

[51] Int. Cl.[2] ..... A47J 31/18

[52] U.S. Cl. ..... 99/323; 366/343; 426/82

[58] Field of Search ..... 99/323, 279, 321, 322; 426/77, 82, 83, 81, 80; 366/342, 343

[56] References Cited

U.S. PATENT DOCUMENTS

| | | | |
|---|---|---|---|
| 829,652 | 8/1906 | Johnson | 99/323 |
| 1,367,568 | 2/1921 | Smith | 99/323 |
| 1,601,613 | 9/1926 | Fenyves | 99/323 |
| 2,092,510 | 9/1937 | Haut | 426/82 |
| 3,342,518 | 9/1967 | Gorton | 426/82 |
| 3,755,895 | 9/1973 | Claasen | 426/82 |
| 3,946,652 | 3/1976 | Gorin | 99/323 |

*Primary Examiner*—Robert W. Jenkins
*Attorney, Agent, or Firm*—Stein & Frijouf

[57] ABSTRACT

An improved infusion and stirring device is disclosed comprising a handle member having a first and a second portion. A first and a second retaining element are respectively secured to the first and the second portion of the handle member to stir an infusion liquid upon movement of the handle member. The first and second retaining elements engage opposite sides of a porous bag containing an infusion solid, such as a tea bag. A latch interconnects the first and second portions of the handle member thereby encompassing the porous bag to retain the porous bag between the first and second retaining elements as the handle member is moved to stir the infusion liquid. The improved structure may be readily injection molded from a plastic material.

6 Claims, 22 Drawing Figures

INFUSION AND STIRRING DEVICE

BACKGROUND OF THE INVENTION

1. Field of the Invention

This invention relates to infusion and more particularly to a combined infusion and stirring device.

2. Description of the Prior Art

The prior art has developed various types of infusion and stirring devices for aiding the infusion of an infusion solid into an infusion liquid. U.S. Pat. No. 1,428,046 shows a handle member and a screen member for holding the infusion solid. U.S. Pat. No. 2,285,113 illustrates a dunking device utilizing a flexible porous bag for the infusion of a solid into a liquid. U.S. Pat. No. 2,291,702 incorporates a spoon and an auxiliary device for the infusion of tea from a tea bag into an infusion liquid such as water. Re. U.S. Pat. No. 21,338 illustrates a tea package contained within a teaspoon. U.S. Pat. No. 3,154,418 discloses a similar device wherein an infusion solid is located within a stirring device such as a teaspoon. U.S. Pat. No 3,755,895 shows a herb spoon for the infusion of a solid into a liquid in a manner similar to the two aforementioned patents. Unfortunately, the aforementioned patents have not completely solved the needs of the art. There is a need for a simple and inexpensive infusion and stirring device which will hold a porous bag and a holding device, which may be distributed to the consumer as a disposable item. Accordingly, it is desirable to manufacture the infusion device from an integral plastic member which can be readily injection molded at low cost.

Therefore it is an object of this invention to provide an apparatus which overcomes the aforementioned inadequacies of the prior art devices and provides an improvement which is a significant contribution to the advancement of the infusion art.

Another object of this invention is to provide an improved infusion and stirring device comprising a handle integrally mounted to retaining means for providing a stirring member upon movement of the handle member while the retaining means receives a porous bag to infuse an infusion solid within the porous bag into the infusion liquid.

Another object of this invention is to provide an improved infusion and stirring device wherein the retaining means comprises a first and a second retainer element respectively secured to a first and a second portion of the handle member with an integral hinge interposed therebetween enabling the first and second retaining elements to engage opposed sides of the porous bag.

Another object of this invention is to provide an improved infusion and stirring device wherein a handle member has a first and a second portion for respectively receiving a first and a second retaining element with a hinge interposed between the first and second handle portions and latch means interconnecting the first and second portions of the handle member enabling the retaining elements to encompass a porous bag therebetween.

Another object of this invention is to provide an improved infusion and stirring device which may be molded by an injection molding process in a flat state and subsequently bent along an integral hinge for engaging opposed sides of a porous bag with an integral latch for locking the first and second handle portions to encompass the porous bag.

Another object of this invention is to provide an improved infusion and stirring device which may be readily manufactured at an economical price for disposable use.

Other objects and a fuller understanding of this invention may be had by referring to the summary of the invention, the description and the claims, taken in conjunction with the accompanying drawings.

SUMMARY OF THE INVENTION

The invention may be incorporated into an improved infusion and stirring device. The term infusion as used throughout the specification refers to the process whereby a solid or semisolid material is immersed into a liquid such that the liquid absorbs a portion of the physical character of the infusion solid. A typical example of infusion is found in the common tea bag or coffee pot whereby the infusion solid tea or coffee is infused within an infusion liquid such as water. Although the invention is disclosed with reference to tea or coffee it should be understood that the invention is not limited by these examples. The instant invention is applicable to most infusion of solids and liquids.

The device comprises a handle member and retaining means secured to the handle member for stirring an infusion liquid with the retaining means upon movement of the handle member. The retaining means defines an internal volume which is capable of receiving a porous or otherwise permeable bag for containing an infusion solid. The retaining means encompasses the porous bag to retain the porous bag in the retaining means while concomitantly enabling interaction between the infusion liquid and the infusion solid.

In a more specific example of the invention, the retaining means may comprise a fixed retaining basket secured to the handle member. In another example, the retaining means may comprise a plurality of arms extending perpendicular to the handle member. Another variation of the invention comprises a substantially annular ring secured to the handle member to encompass the porous bag.

The retaining means may be fixed relative to the handle member thereby having a fixed internal volume. In the alternative, the retaining means may comprise a first and a second retaining element respectively mounted to a first and a second portion of the handle member. In this embodiment the first and second retaining elements engage opposed sides of the porous bag. Preferably, a hinge is disposed between the first and second portions of the handle member enabling the device to be injection molded in a plane and subsequently folded about the hinge means to engage opposed sides of the porous bag. In this example, a latch may be provided for securing the first and second portions of the handle member in fixed relationship to the encompassed porous bag.

In a more specific example, each of the first and second retaining elements comprises at least an arm extending perpendicularly relative to the handle member. Each of the arms includes a bend at the terminal end of the arm for encompassing the porous bag.

The hinge means is preferably disposed mid-point between the first and second retaining elements for locating the first retaining element adjacent the second retaining element upon folding the handle member about the hinge. The latch may comprise a projection in one of the first and second hinge portions for engaging an aperture in the other of the first and second handle portions. This invention accordingly comprises an apparatus possessing the features, properties and the relation of elements which will be exemplified in the article hereinafter described, and the scope of the invention will be indicated in the claims.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
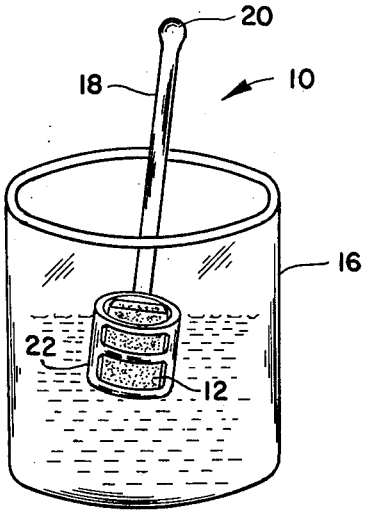
FIG. 1 is a perspective view of an improved infusion and stirring device located within an infusing liquid.

FIG. 1 illustrates a new device 10 for stirring and infusing a solid material within a porous bag 12 into a liquid material 14 in a glass 16. The infusion liquid may be hot or cold water whereas the solid infusion material in porous bag 12 may be tea, coffee, dye or the like. Although the invention will be specifically disclosed for use with a water liquid infusion material and with coffee, tea or dye being the solid infusion material, it should be understood that the disclosed invention is equally adaptable to most liquid and solid infusion processes.

Figure 2:
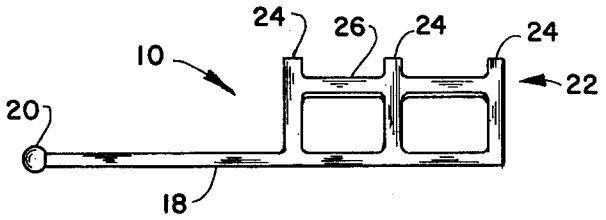
FIG. 2 is a side elevational view of the improved device shown in FIG. 1.
Figure 4:
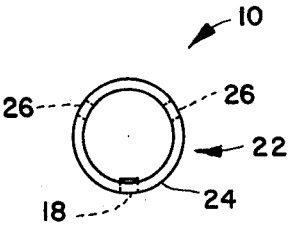
FIG. 4 is a right end view of the device shown in FIG. 2.
Figure 3:
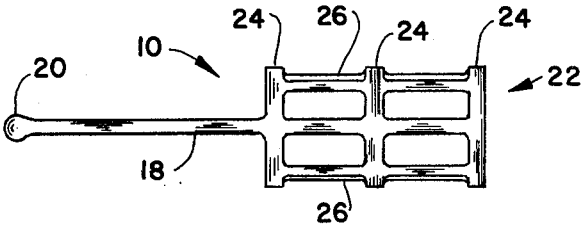
FIG. 3 is a bottom view of the stirring device shown in FIG. 2.
Figure 5:
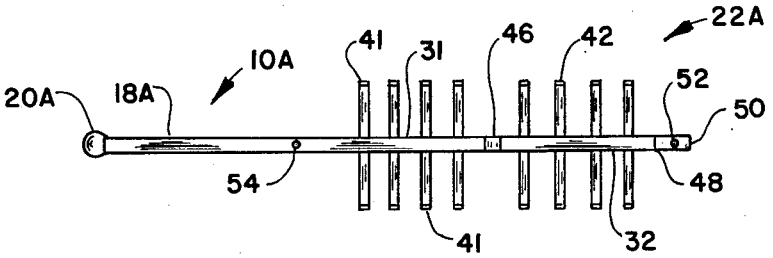
FIG. 5 is a plan view of a second embodiment of the invention illustrating a new and improved infusion and stirring device.

FIGS. 2–4 show more detailed views of the device 10 comprising a handle 18 having a rounded safety end projection 20 and retaining means shown generally as 22. The retaining means 22 in this embodiment includes plural annular rings 24 disposed tangentially to the handle member 18. Plural reinforcement bars 26 extend parallel to the handle member 18 to space and reinforce the annular rings 24. The annular rings 24 and the reinforcement bars 26 form a fixed volume retaining basket with handle member 18 to retain the porous bag 12 therein while simultaneously enabling infusion of the solid material into the infusion liquid 14. The invention shown in FIGS. 1–4 may be injected molded from a single piece of plastic. It should be understood that the annular rings 24 may take various other shapes such as triangular, square, polygon and the like.

FIGS. 5–8 show a second embodiment of the invention illustrating the device 10A comprising a handle member 18A including a rounded end projection 20A and retaining means shown generally as 22A. The handle member 18A comprises a first and a second handle member portion 31 and 32. The retaining means 22A more specifically comprises a first and a second retaining element 41 and 42 respectively secured to the first and second handle portions 31 and 32. In this embodiment the first and second retaining elements 41 and 42 each comprise a plurality of arms extending on opposed sides of the handle member portion 31 and 32 in a substantially perpendicular relationship therewith. The plurality of arms are equally spaced with each arm having an upturned end at bend 44 which is more fully shown in FIGS. 6–8.

A hinge 46 is interposed between the first and second handle member portion 31 and 32. More specifically, the hinge 46 is spaced mid-point between the first and second retaining elements 41 and 42. The hinge 46 may be a weakening or a reduced cross-sectional area within the handle member 18A as more fully shown in FIG. 6.

Figure 6:
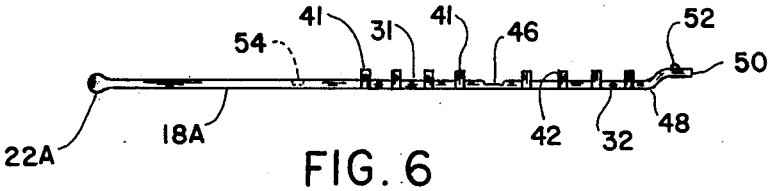
FIG. 6 is a side elevational view of the device shown in FIG. 5.
Figure 7:
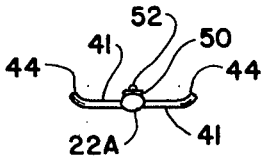
FIG. 7 is a left end view of the device shown in FIG. 6.
Figure 8:
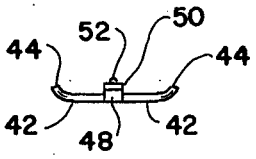
FIG. 8 is a right end view of the device shown in FIG. 6.
Figure 9:
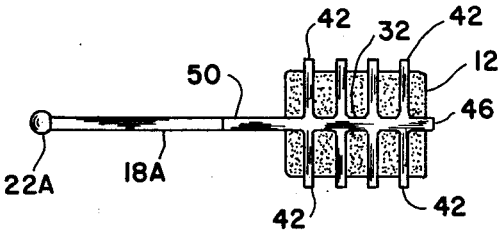
FIG. 9 is a plan view of the device shown in FIGS. 5–8; encompassing a porous bag.

The second handle portion 32 has a double bend 48 producing a latch portion 50 which is substantially parallel, but elevated, from the remainder of handle member 18A as shown in FIG. 6. The latch portion 50 receives a latch to engage with the first handle member portion 31 to lock the porous bag 12 as shown in FIGS. 9–12. In this embodiment, the latch portion 50 receives a projection 52 which is receivable within an aperture 54 located within the first handle member portion 31.

Figure 21:
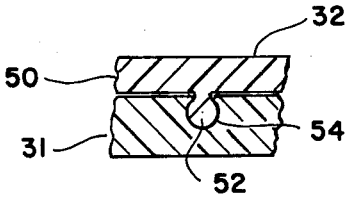
FIG. 21 is an enlarged view of the specific type of latch mechanism shown in the embodiment of FIGS. 5–20.

FIG. 21 is a magnified view of the cooperation of the projection 52 and the aperture 54 in the device shown in FIGS. 5–12. The projection 52 is received in aperture 54 upon deformation of the plastic material. It should be understood that numerous variations of the projection 52 and the aperture 54 may be resorted to without departing from the scope of the claimed invention. It should also be understood that other types of snaps and fastening means may be utilized to secure the second handle portion 32 to the first handle portion 31. Such variations are considered to be equivalent to the disclosed structure.

Figure 12:
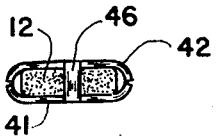
FIG. 12 is a right end view of the device shown in FIG. 10.
Figure 10:
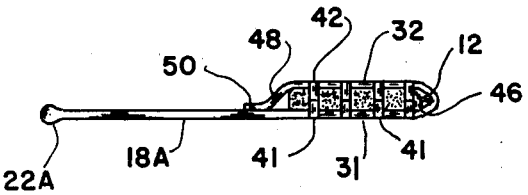
FIG. 10 is a side elevational view of the device shown in FIG. 9 encompassing the porous bag.
Figure 11:
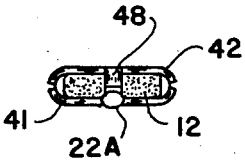
FIG. 11 is a left end view of the device shown in FIG. 10.
Figure 13:
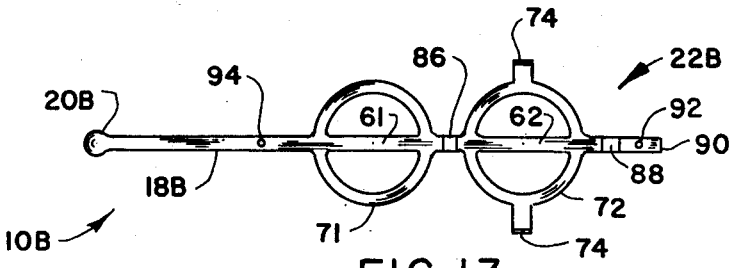
FIG. 13 is a plan view of a third embodiment of the invention illustrating a new improved infusion and stirring device.
Figure 14:
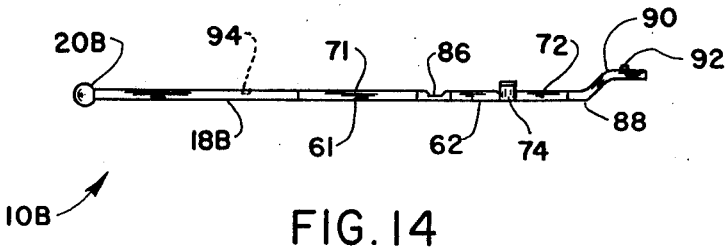
FIG. 14 is a side elevational view of the device shown in FIG. 13.
Figure 15:
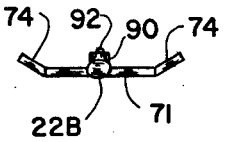
FIG. 15 is a left end view of the device shown in FIG. 14.
Figure 16:
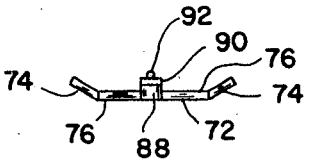
FIG. 16 is a right end elevational view of the device shown in FIG. 14.
Figure 17:
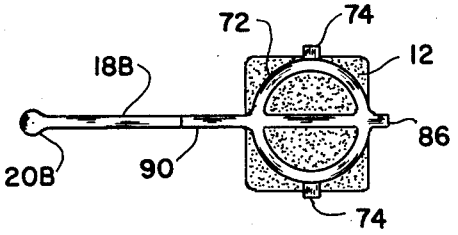
FIG. 17 is a plan view of the devices shown in FIGS. 13–16 encompassing a porous bag.
Figure 20:
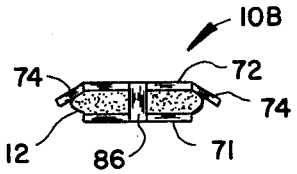
FIG. 20 is a right end view of the device shown in FIG. 18.
Figure 18:
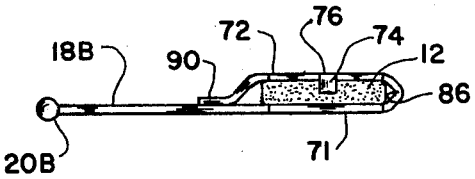
FIG. 18 is a side elevational view of the device shown in FIG. 17.
Figure 19:
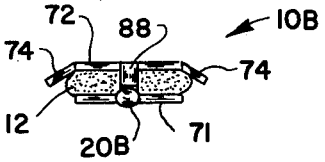
FIG. 19 is a left end view of the device shown in FIG. 18.

FIGS. 9–12 illustrate various views of the device 10A shown in FIGS. 5–8 with the second handle portion 32 folded on hinge 46 to encompass the porous bag 12. FIGS. 10–12 show how the bends 44 enable the terminal ends of first retaining elements 41 to essentially contact with the terminal end of second retaining elements 42 to encompass the porous bag 12.

FIGS. 13–20 illustrate a third embodiment of the invention. In this embodiment, the device 10B comprises a handle member 18B having a rounded end projection 20B and retaining means 22B. The handle portion 18B comprises a first and a second handle portion 61 and 62 for respectively receiving a first and a second retaining element 71 and 72. The first and second retaining elements 71 and 72 are substantially annular and tangentially extend from the first and second handle member portions 61 and 62. The second retaining element 72 comprises plural arms 74 extending therefrom with each arm having a bend 76 shown in FIGS. 15 and 16. A hinge 86 is disposed between the first and second retaining elements 71 and 72 in a similar fashion to the hinge 46 in FIGS. 5–12. The second handle portion 62 includes a double bend 88 defining a latch portion 90 for receiving a projection 92. The projection 92 is cooperable with an aperture 94 in the first handle portion 61 in a manner similar to that shown in FIG. 21.

FIGS. 17–20 illustrate various views of the device 10B shown in FIGS. 13–16 encompassing the porous bag 12. The function and operation of the device 10B is similar to that shown in 10A. The arms 74 cooperate with the first retaining element 71 to encompass the porous bag 12 in a manner similar to the first and second retaining elements 41 and 42 in device 10A.

The embodiments shown in FIGS. 5–21 provide a novel device which may be injection molded as a flat member and subsequently bent about hinges 46 and 86 to encompass a porous bag member. The use of an initially flat member which is subsequently folded, enables a low cost die to be used in making the device very inexpensive and desirable for a disposable item. In the alternative, the first and second handle member portions 31 and 32 and 61 and 62 may be separate pieces secured together by plural latches or the like. It should be further understood that more than three pieces may be utilized and secured by plural hinges, latches, tracks or other means of connection.

Figure 22:
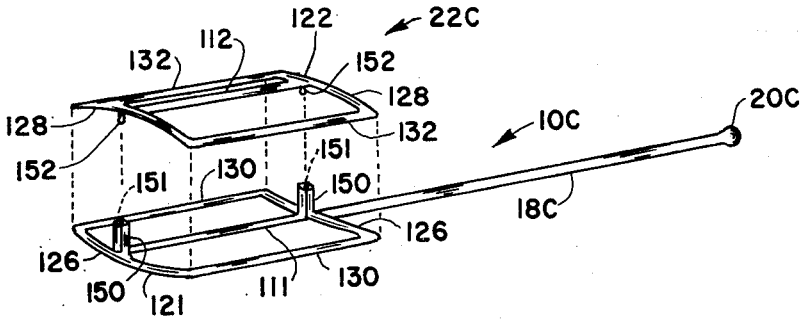
FIG. 22 is a perspective exploded view of a further embodiment of the invention.

FIG. 22 illustrates a device 10C which is a variation of the invention shown in FIGS. 1–21. The device 10C comprises a handle member 18C including a rounded end projection 20C and retaining means shown generally as 22C. The handle member 18C comprises a first and a second handle member portion 111 and 112. The retaining means more specifically comprises a first and a second retaining element 121 and 122 respectively secured to the first and second hand portions 111 and 112. In this embodiment, the first and second retaining elements 121 and 122 each comprise a plurality of arcuate arms 126 and 128 extending on opposed sides of the handle member portions 111 and 112 in a substantially perpendicular relationship therewith. The arcuate arms 126 and 128 are respectively secured to end bars 130 and 132 for encompassing the porous bag (not shown). In this embodiment, latch portions 150 position apertures 151 for receiving projections 152 to secure the retaining elements 121 and 122 to encompass the porous bag (not shown). The projections 152 and aperture 151 may be similar to those shown in FIG. 21.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described

What is claimed:

1. An improved infusion and stirring device comprising in combination:

a handle member having a first and a second portion;

each of said handle member portions comprising a longitudinally extending beam having a substantially constant cross sectional area;

a first and a second retaining element respectively secured to said first and second portions of said handle member for stirring an infusion liquid upon movement of said handle member;

each of said first and second retaining elements comprising at least an arm extending perpendicularly relative to said longitudinally extending beam;

a hinge interposed between said first and second portions of said handle member enabling said first and second retaining elements to engage opposed sides of a porous bag containing an infusion solid; and a latch interconnecting said first and second portions of said handle member for retaining the porous bag between said first and second retaining elements.

2. A device as set forth in claim 1, wherein each of said arms includes a bend in the terminal end thereof for encompassing the porous bag.

3. A device as set forth in claim 1, wherein each of said first and second retaining elements comprises an annular ring extending from said handle member to contact only the peripheral region of the porous bag.

4. A device as set forth in claim 1, wherein said first and second handle member portions are disposed along a common line extending through said longitudinal beams; and said hinge means being disposed between said first and second retaining elements for locating said first retaining element adjacent to said second retaining element upon folding said handle member about said hinge.

5. A device as set forth in claim 1, wherein said latch comprises a projection in one of said first and second handle portions and an aperture for receiving said projection disposed in the other of said first and second handle portions;

one of said projection and said aperture being a deformable plastic material enabling said projection to be forced into said aperture and retained therein.

6. An improved infusion and stirring device comprising in combination:

a handle member having a first and a second portion;

a first and a second retaining element respectively secured to said first and second portions of said handle member for stirring an infusion liquid upon movement of said handle member;

said first and second retaining elements comprising a plurality of arcuate arms extending on opposed sides of said first and second handle member portions;

said arcuate arms respectively secured to end bars for encompassing a porous bag;

latch means interconnecting said first and second portions of said handle member for retaining the porous bag between said first and second retaining elements;

said latch means comprising plural projections cooperating with plural apertures; and one of said projections and said apertures being a deformable plastic enabling said projection to be forced into said aperture and be retained therein.

* * * * *